US008384646B2

(12) United States Patent
Park et al.

(10) Patent No.: US 8,384,646 B2
(45) Date of Patent: Feb. 26, 2013

(54) LIQUID CRYSTAL DISPLAY

(75) Inventors: Mangyu Park, Seoul (KR); Jincheol Hong, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 681 days.

(21) Appl. No.: 12/645,168

(22) Filed: Dec. 22, 2009

(65) Prior Publication Data

US 2011/0012822 A1 Jan. 20, 2011

(30) Foreign Application Priority Data

Jul. 15, 2009 (KR) ..... 10-2009-0064628

(51) Int. Cl.
*G09G 3/36* (2006.01)

(52) U.S. Cl. ..... 345/99; 345/96

(58) Field of Classification Search ..... 345/87, 345/96, 99, 211, 103
See application file for complete search history.

(56) References Cited

U.S. PATENT DOCUMENTS

2008/0036721 A1* 2/2008 Kim et al. ..... 345/96
2008/0297539 A1* 12/2008 Kim et al. ..... 345/690

* cited by examiner

*Primary Examiner* — Hoa T Nguyen
*Assistant Examiner* — Andrew Sasinowski
(74) *Attorney, Agent, or Firm* — Morgan, Lewis & Bockius LLP

(57) ABSTRACT

A liquid crystal display including a liquid crystal display panel including a plurality of data lines, a plurality of gate lines intersecting the data lines, and liquid crystal cells respectively formed at intersections of the data lines and the gate lines, and divided into a first area, a second area and a third area, a first data integrated circuit (IC) that drives the first area, a second data IC that drives the second area, a third data IC that drives the third area, and a timing controller that analyzes an input digital video data, generates a first selection signal and a second selection signal for controlling whether charge sharing is used, and independently controls the first, second, and third data ICs using the first and second selection signals, wherein the second area is divided into a first block adjoining the first area, a third block adjoining the third area and a second block located between the first block and the third block; and the first selection signal controls whether the charge sharing is used for the first and third data ICs, and the second selection signal controls whether the charge sharing is used for the second block and controls a charging delay variation so that the charging delay variation is lessened between the second block and the first area or between the second block and the third area in the first or third block.

10 Claims, 15 Drawing Sheets

| D-IC position | | TAB1 | TAB2 | TAB3 |
|---|---|---|---|---|
| Pattern | | Pattern having low power consumption when C/S is used | Composite Pattern | Pattern having low power consumption when C/S is not used |
| Consumption Power | C/S is used | Decrease | – | Increase |
| | C/S is not used | Increase | – | Decrease |

| DIC position / Function | DIC1 | DIC2 | | | DIC3 |
|---|---|---|---|---|---|
| | | BL1 | BL2 | BL3 | |
| OP1 | EN | EN | EN | EN | EN |
| OP2 | EN | EN | EN | DLD | DIS |
| OP3 | EN | DLD | DIS | ILD | EN |
| OP4 | EN | DLD | DIS | DIS | DIS |
| OP5 | DIS | ILD | EN | EN | EN |
| OP6 | DIS | ILD | EN | DLD | DIS |
| OP7 | DIS | DIS | DIS | ILD | EN |
| OP8 | DIS | DIS | DIS | DIS | DIS |

EN:C/S is used
DIS:C/S is not used
ILD:Increased L/D
DLD:Decreased L/D

LIQUID CRYSTAL DISPLAY

This application claims the benefit of the Korean Patent Application No. 10-2009-0064628 filed on Jul. 15, 2009, which is hereby incorporated by reference.

BACKGROUND OF THE INVENTION

1. Field of the Invention

The present invention relates to a liquid crystal display (LCD), and more particularly, to an LCD for reducing power consumption and improving display quality.

2. Discussion of the Related Art

To display an image, an LCD controls optical transmissivity of liquid crystal cells according to a video signal. An active matrix LCD switches a data voltage supplied to liquid crystal cells using thin film transistors respectively formed at the liquid crystal cells to actively control data, and thus the active matrix LCD can improve display quality of moving images.

The LCD inverts the polarity of a data voltage charged in every group of a predetermined number of liquid crystal cells in order to reduce a DC offset component and degradation of liquid crystal. However, this inversion driving method increases the swing width of the data voltage supplied to data lines whenever the polarity of the data voltage is changed and raises a temperature of a data driving circuit. As a result, power consumption is increased.

A related art charge sharing method as shown in FIGS. 1A and 1B has been proposed to reduce the swing width of the data voltage, the temperature of the data driving circuit, and its power consumption, The charge sharing method turns on a charge share switch SW1 connected between neighboring output channels of the data driving circuit during a logic high period of a source output enable signal SOE to share positive charges and negative charges in a panel so as to change the initial output level of the data driving circuit to a middle level.

However, the related art charge sharing method cannot reduce power consumption of the data driving circuit all the time. The charge sharing method has an advantage of low power consumption when a data pattern having a large difference between output levels continuously output through a same channel is displayed. However, when a data pattern having a small output level difference is displayed, it is more effective for low power consumption to output the output voltages while maintaining previous output levels, as shown in FIGS. 2A and 2B, without using the charge sharing method.

The related art charge sharing method determines whether the charge sharing function is used irrespective of characteristics of a data pattern input to the data driving circuit, and uniformly applies the determination result to all data integrated circuits (data ICs) constructing the data driving circuit. In this case, data patterns in which difference of power consumption is large depending on whether the charge sharing function is used may be respectively input to different data ICs. Consequently, power consumption of a specific data IC increases compared to other data ICs. Thus, the conventional charge sharing method cannot achieve low power consumption.

For example, FIG. 3 illustrates a data pattern having an advantage of low power consumption when charge sharing is used, a composite data pattern, and a data pattern having an advantage of lower power consumption when the charge sharing is not used are respectively applied to first, second and third data ICs TAB1, TAB2 and TAB3. As shown, power consumption of the third data IC TAB3 increases while power consumption of the first data IC TAB1 decreases. When the charge sharing is not uniformly used for the data ICs TAB1, TAB2 and TAB3, power consumption of the third data IC TAB3 decreases while power consumption of the first data IC TAB1 increases.

SUMMARY OF THE INVENTION

Accordingly, the present invention is directed to a liquid crystal display device that substantially obviates one or more problems due to limitations and disadvantages of the related art.

An object of the present invention is to provide an LCD for analyzing an input data pattern and independently determining whether charge sharing is used for respective data ICs to achieve improved power consumption.

Another object of the present invention is to provide an LCD for independently determining whether charge sharing is used for respective data ICs to solve block dim between data ICs.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display device includes a liquid crystal display panel including a plurality of data lines, a plurality of gate lines intersecting the data lines, and liquid crystal cells respectively formed at intersections of the data lines and the gate lines, and divided into a first area, a second area and a third area, a first data integrated circuit (IC) that drives the first area, a second data IC that drives the second area, a third data IC that drives the third area, and a timing controller that analyzes an input digital video data, generates a first selection signal and a second selection signal for controlling whether charge sharing is used, and independently controls the first, second, and third data ICs using the first and second selection signals, wherein the second area is divided into a first block adjoining the first area, a third block adjoining the third area and a second block located between the first block and the third block; and the first selection signal controls whether the charge sharing is used for the first and third data ICs, and the second selection signal controls whether the charge sharing is used for the second block and controls a charging delay variation so that the charging delay variation is lessened between the second block and the first area or between the second block and the third area in the first or third block.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 6 is applied to FIG. 7;

DETAILED DESCRIPTION OF THE EMBODIMENTS

Reference will now be made in detail to the embodiments of the present invention, examples of which are illustrated in the accompanying drawings. Embodiments of the invention will be explained in detail with reference to FIGS. 4 through 17.

Figure 1A:
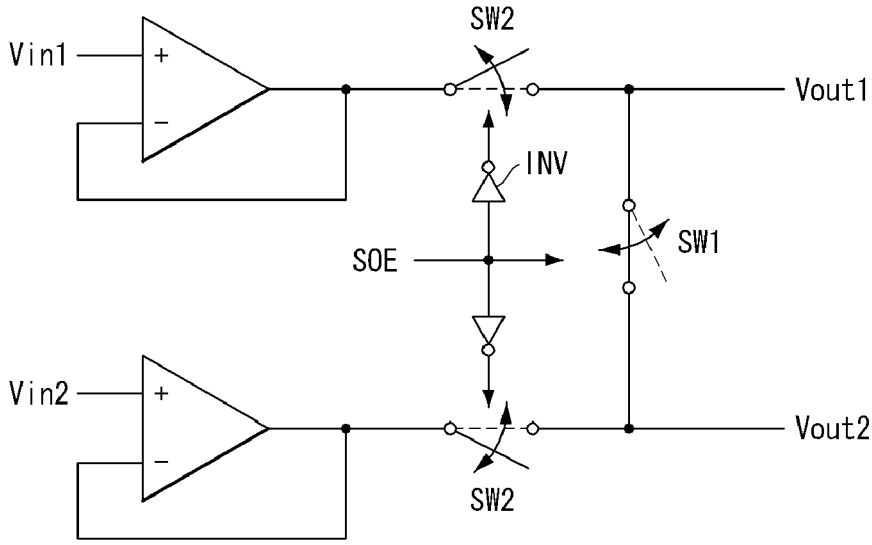
FIG. 1A RELATED ART
FIGS. 1A and 1B illustrate a circuit diagram and an output waveform diagram when the related art charge sharing method is used.
Figure 1B:
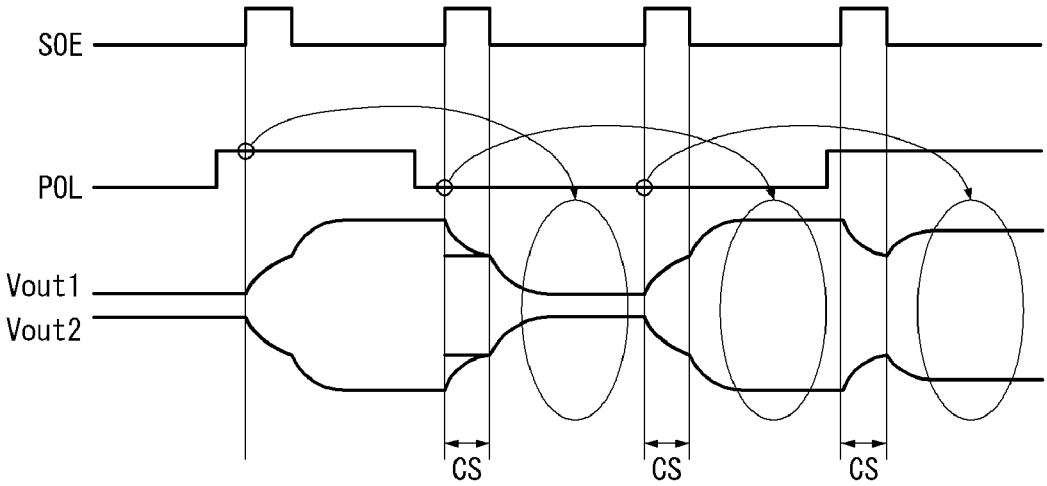
FIG. 1B RELATED ART
Figure 2A:
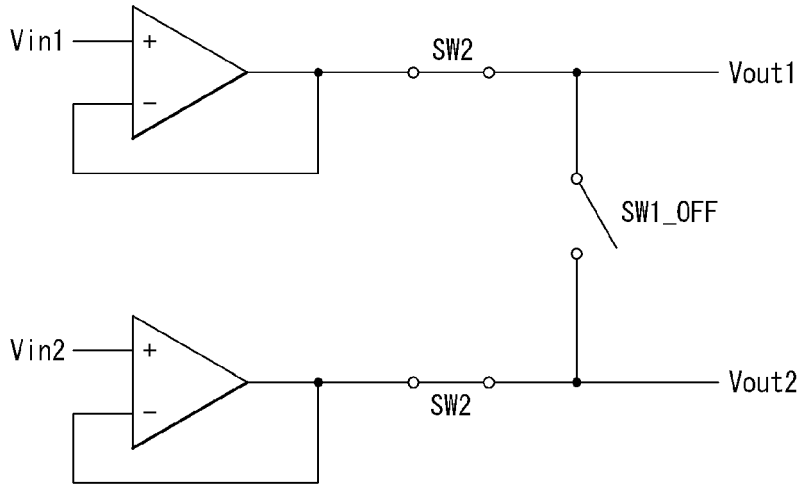
FIG. 2A RELATED ART
FIGS. 2A and 2B illustrate a circuit diagram and an output waveform diagram when the related art charge sharing method is not used.
Figure 2B:
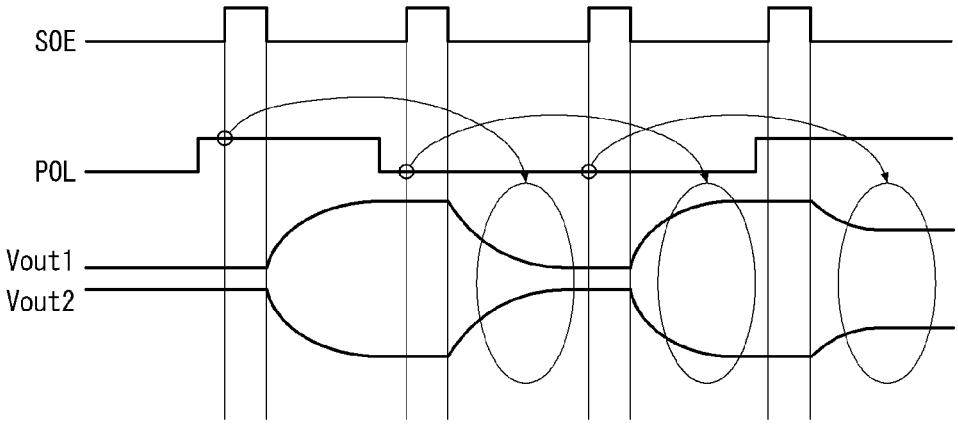
FIG. 2B RELATED ART
Figures 3, 4:
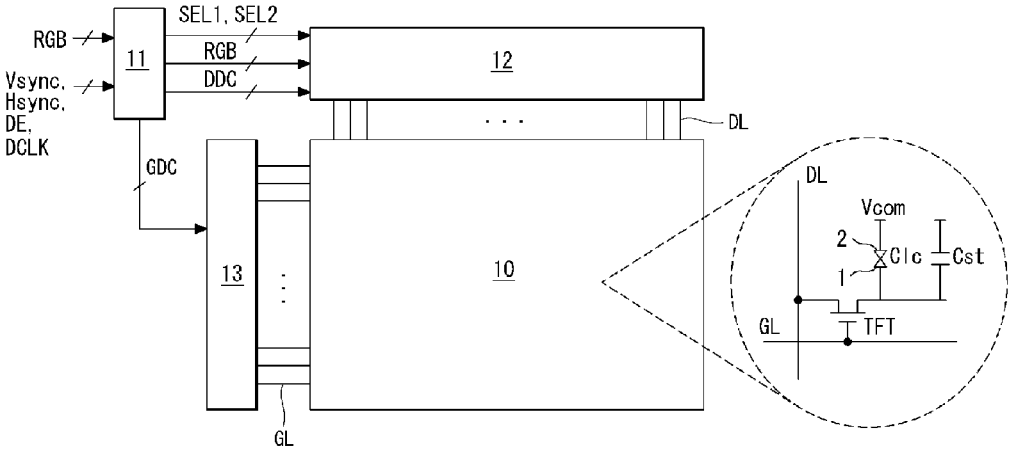
FIG. 3 RELATED ART
FIG. 3 illustrates changes in power consumption of a plurality of data ICs when the related art charge sharing method is applied to all the data ICs and when the related art charge sharing method is not applied to all the data ICs.
FIG. 4 is a block diagram of an LCD according to an embodiment of this invention.

FIG. 4 is a block diagram of an LCD according to an embodiment of this invention. As shown in FIG. 4, the LCD according to the current embodiment of the invention includes an LCD panel 10, a timing controller 11, a data driving circuit 12, and a gate driving circuit 13. The LCD panel 10 includes liquid crystal molecules dispensed between two glass substrates.

The LCD panel 10 also includes a plurality of data lines DL, a plurality of gate lines GL intersecting the data lines DL, and liquid crystal cells Clc respectively arranged at intersections of the data lines DL and the gate lines GL in a matrix form. The plurality of data lines DL, the plurality of gate lines GL, thin film transistors (TFTs), pixel electrodes 1 of the liquid crystal cells Clc respectively connected to the TFTs, and a storage capacitor Cst are formed on the lower glass substrate of the LCD panel 10. A black matrix, a color filter, and common electrode 2 facing the pixel electrode 1 are formed on the upper glass substrate of the LCD panel 10. The common electrode 2 is formed on the upper glass substrate in a vertical field driving mode, such as a twisted nematic (TN) mode and a vertical alignment (VA) mode and formed together with the pixel electrodes 1 on the lower glass substrate in a horizontal field driving mode such as an in-plane switching (IPS) mode and a fringe field switching (FFS) mode.

Polarizers having optical axes perpendicular to each other are respectively attached to the upper and lower glass substrates of the LCD panel 10 and alignment films for setting a pretilt angle of liquid crystal are respectively formed on the inner sides of the upper and lower glass substrates, which come into contact with the liquid crystal.

The timing controller 11 receives timing signals such as vertical and horizontal synchronization signals Vsync and Hsync, a data enable signal DE and a clock signal DCLK. The timing controller 11 generates control signals including data control signals DDC and gate control signals GDC for controlling operation timing of the data driving circuit 12 and the gate driving circuit 13. The gate control signals GDC include a gate start pulse signal GSP, a gate shift clock signal GSC and a gate output enable signal GOE (not shown). The data control signals DDC include a source start pulse signal SSP, a source sampling clock signal SSC, a source output enable signal SOE and a polarity control signal POL (not shown).

The timing controller 11 re-arranges input digital video data RGB such that the input digital video data RGB becomes suitable for the LCD panel 10 and supplies the digital video data RGB to the data driving circuit 12. Particularly, the timing controller 11 analyzes the input digital video data RGB and generates first and second selection signals SEL1 and SEL2 for independently controlling whether charge sharing is used for respective data ICs based on the analysis result. Here, the first selection signal SEL1 is used to control whether charge sharing is used for a corresponding data IC. The second selection signal SEL2 is used to not only control whether charge sharing is used for a corresponding data IC but also to gently vary an abrupt charging delay variation in a boundary block between a data IC to which charge sharing is applied and a data IC to which charge sharing is not applied.

The gate driving circuit 13 includes a plurality of gate ICs and sequentially outputs scan pulses having a pulse width corresponding to approximately one horizontal period. The gate IC has a shift register, a level shifter for changing an output signal of the shift register such that the output signal has a swing width suitable to operate TFTs of liquid crystal cells, and output buffers connected between the level shifter and gate lines G1 through Gn. The scan pulses are supplied to the gate lines GL to select a horizontal line to which a data voltage is applied.

The data driving circuit 12 latches the digital video data RGB under the control of the timing controller 11, converts the digital video data RGB into analog positive/negative gamma compensated voltages to generate positive/negative data voltages. The data driving circuit 12 also provides the positive/negative data voltages to data lines D1 through Dm.

Figure 5:
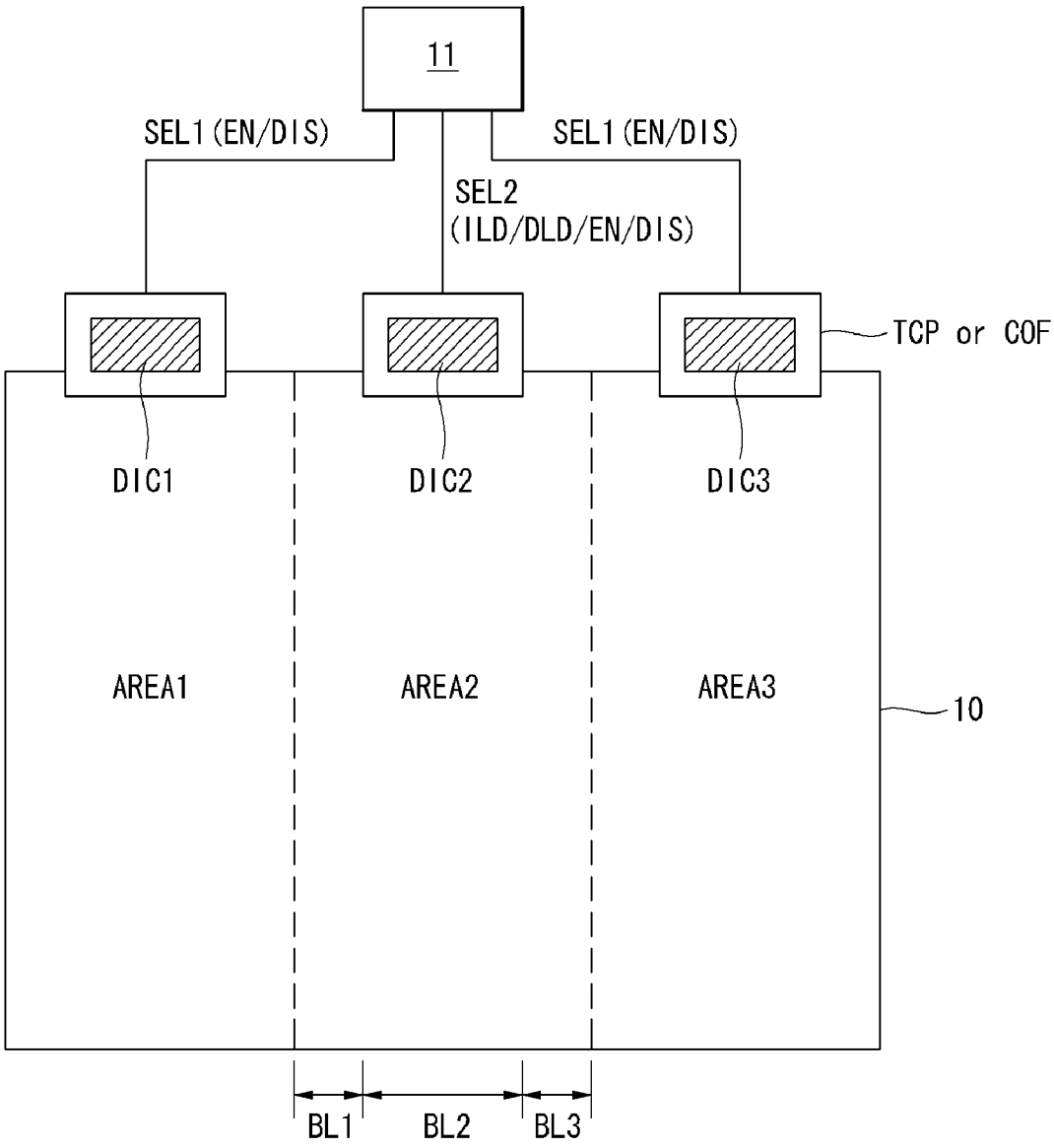
FIG. 5 illustrates selection signals supplied to a data driving circuit from a timing controller of FIG. 4.

FIG. 5 illustrates selection signals SEL1 and SEL2 supplied to a data driving circuit from a timing controller of FIG. 4.

As shown in FIG. 5, the data driving circuit 12 includes a plurality of data ICs DIC1, DIC2 and DIC3. The plurality of data ICs DIC1, DIC2 and DIC3 are respectively mounted on source chip on films (COFs). The source COFs may be replaced by source tape carrier packages (TCPs).

Input terminals of the source COFs are electrically connected to output terminals of a source printed circuit board (PCB) (not shown) and output terminals of the source COFs are electrically connected to data pads formed on the lower glass substrate of the LCD panel 10. The LCD panel 10 has three areas AREA1, AREA2, and AREA3 which are independently driven by the data ICs DIC1, DIC2, and DIC3. Although three data ICs are described in the embodiment for convenience of explanation, the invention is not limited thereto and the number of data ICs can be four or more. The second area AREA 2 of the LCD panel 10 is divided into a first block BL1 adjoining the first area AREA1, a third block BL3 adjoining the third area AREA2 and a second block BL2 located between the first and third blocks BL1 and BL3. The first, second, and third blocks BL1, BL2, and BL3 are independently driven according to the second selection signal SEL2.

The first and third data ICs DIC1 and DIC3 respectively drive the first and third areas AREA1 and AREA3 of the LCD panel 10 and receive one of an enable signal EN and a disenable signal DIS as the first selecting signal SEL1 according to the attribute of data to be displayed in the first and third areas AREA1 and AREA3. The enable signal EN is a control signal for instructing charge sharing to be used for a data pattern having an advantage of low power consumption when charge sharing is used. The disenable signal DIS is a control signal for instructing no charge sharing to be used for a data pattern having an advantage of low power consumption when charge sharing is not used. The first and third data ICs DIC1 and DIC3 perform charge sharing on n (n is a positive integer) output channels during a logic high period of the source output enable signal SOE in response to the enable signal EN to change an initial output level to a middle level. Further, the first and third data ICs DIC1 and DIC3 do not perform charge sharing on the n output channels in response to the disenable signal DIS and output data outputs while maintaining the previous level.

The second data IC DIC2 drives the second area AREA2 located between the first and third areas AREA1 and AREA3 of the LCD panel 10 and receives one of the enable signal EN and the disenable signal DIS, and one of a load delay signal ILD (hereinafter, referred to as a first load delay signal) for controlling a charging delay to gradually increase and a load delay signal DLD (hereinafter, referred to as a second load delay signal) for controlling the charging delay to gradually decrease as the second selecting signal SEL2 according to the attribute of data to be displayed in the second area AREA2. Among n (n is a positive integer) output channels of the second data IC DIC2, k ($k \leqq n/2$) output channels on the left side (first channel group) and k channels on the right side (third channel group) respectively drive the first block BL1 and the third block BL3 and receive one of the enable signal EN, the disenable signal DIS, the first load delay signal ILD, and the second load delay signal DLD as the second selection signal SEL2. (n−2k) middle channels (second channel group) among the output channels of the second data IC DIC2 receives one of the enable signal EN and the disenable signal DIS as the second selection signal SEL2. The enable signal EN and the disenable signal DIS have been explained above. The first load delay signal ILD is a control signal used to gently increase a charging delay in a boundary block BL1 or BL3 in which the charging delay increases. The second load delay signal DLD is a control signal used to gently reduce the charging delay in a boundary block BL1 or BL3 in which the charging delay abruptly decreases. Here, the charging delay is defined as a degree of delay at a data charging time. The quantity of data charged in liquid crystal cells decreases as the charging delay increases because the gate turn-off time of a TFT is fixed according to a scan pulse signal (that is, a single horizontal period is fixed). The charging delay when charge sharing is used is greater than the charging delay when charge sharing is not used.

The second data IC DIC2 performs charge sharing on the middle (n−2k) channels during a logic high period of the source output enable signal SOE in response to the enable signal EN to change an initial output level to a middle level. The second data IC DIC2 does not perform charge sharing on the middle (n−2k) channels in response to the disenable signal DIS and outputs a data output while maintaining the previous level.

The second data IC DIC2 gradually delays the source output enable signal SOE in response to the first load delay signal ILD to gently increase the charging delay as the source output enable signal SOE is transmitted through the k channels on the left side and/or right side from the left to the right. The second data IC DIC2 gradually delays the source output enable signal SOE in response to the second load delay signal DLD to gently decrease the charging delay as the source output enable signal SOE is transmitted through the k channels on the left side and/or right side from the left to the right.

When charging delays in neighboring areas (for example, AREA1 and BL2 or BL2 and AREA2) having the boundary block BL1 or BL3 located between them are identical to each other and maintained, the second data IC DIC2 performs charge sharing on the k channels on the left side and/or right side in response to the enable signal EN or does not perform charge sharing on the k channels on the left side and/or right side in response to the disenable signal DIS to make the charging delay in the boundary block BL1 or BL3 correspond to those of the neighboring areas.

Figures 6, 7:
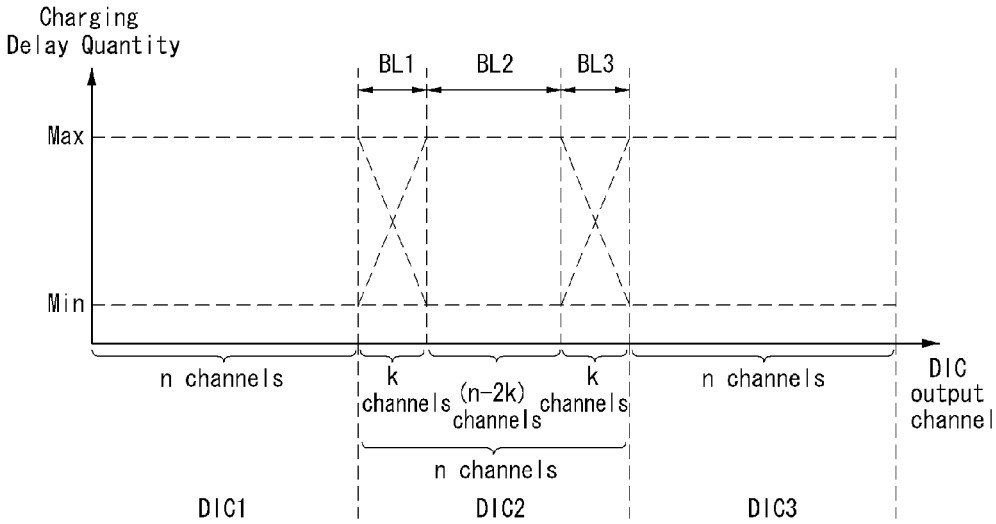
FIG. 6 illustrates an exemplary chart showing independently controlling whether charge sharing is used for respective data ICs including a boundary block between neighboring data ICs according to an embodiment of this invention.
FIG. 7 illustrates an exemplary graph showing independently controlling whether charge sharing is used for respective data ICs including a boundary block between neighboring data ICs according to an embodiment of this invention.
Figure 8A:
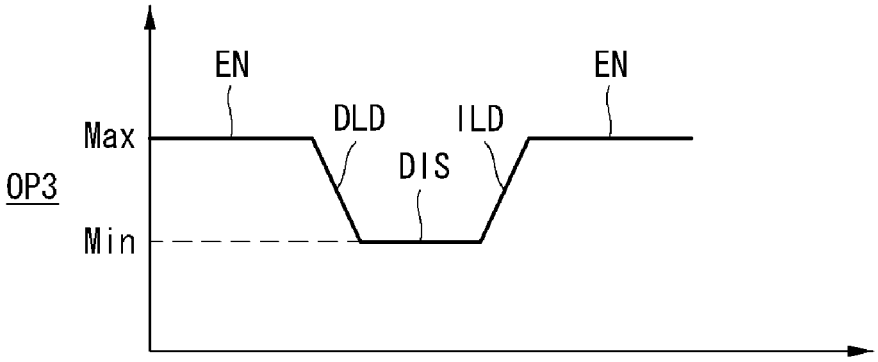
FIGS. 8A, 8B, 8C and 8D show exemplary graphs obtained when
Figure 8B:
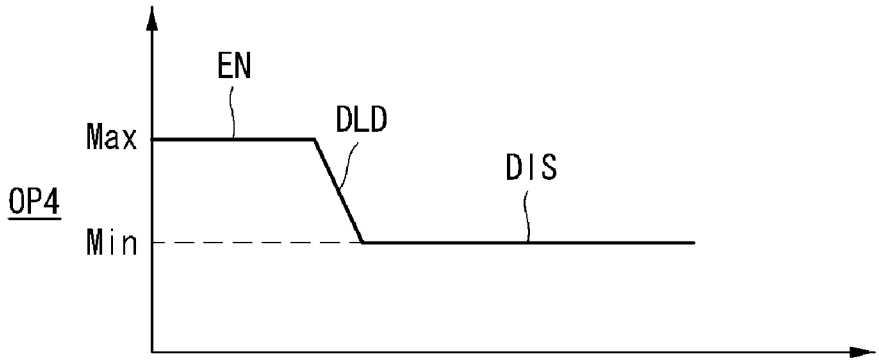
Figure 8C:
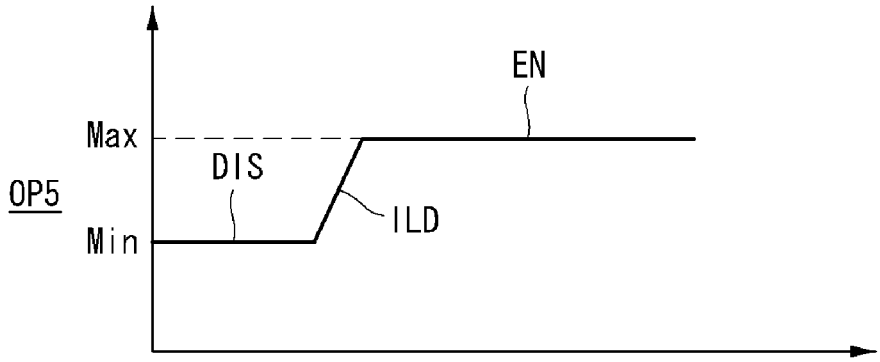
Figure 8D:
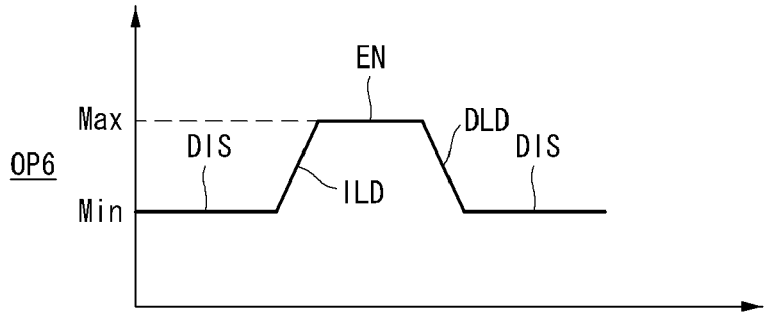

FIG. 6 illustrates an exemplary chart showing independently controlling whether charge sharing is used for respective data ICs including a boundary block between neighboring data ICs. Similarly, FIG. 7 illustrates an exemplary graph showing independently controlling whether charge sharing is used for respective data ICs including a boundary block between neighboring data ICs.

As shown in FIG. 6, the first and third data ICs DIC1 and DIC3 are controlled by one of the enable signal EN and the disenable signal DIS according to the attribute of data applied thereto to perform charge sharing on all the channels or to carry out no charge sharing on all the channels. The second data IC DIC2 is controlled by one of the enable signal EN and the disenable signal DIS according to the attribute of data applied thereto to perform charge sharing on the (n−2k) middle channels or carry out no charge sharing on the (n−2k) middle channels. Further, the second data IC DIC2 is controlled by one of the enable signal EN, the disenable signal DIS, the first load delay signal ILD and the second load delay signal DLD to simultaneously perform charge sharing on the k channels on the left side and/or right side or carry out no charge sharing on the k channels, or perform charge sharing on the k channels such that the charging delay gently increases or decreases as it goes through the k channels from left to right. The k channels on the left and right sides in the second data IC DIC2 respectively drive the first and third boundary blocks BL1 and BL3, and thus operating states of the first and third boundary blocks BL1 and BL3 are determined by operating states of neighboring areas (for example, AREA1 and BL2 or BL2 and AREA2) having the boundary block BL1 or BL3 located between them. That is, the k channels on the left side and/or right side are controlled such that charge sharing is performed on the k channels when charge sharing is carried out on neighboring areas (refer to EN of OP1 and OP2 in FIG. 6) and controlled such that charge sharing is not performed on the k channels when charge sharing is not carried out on the neighboring areas (refer to DIS of OP7 and OP8 in FIG. 6). Further, the k channels on the left side and/or right side are controlled such that the charging delay gently decreases as it goes through the k channels from left to right when charge sharing is performed on the left area adjacent to the k channels (EN, charging delay is large) and charge sharing is not carried out on the right area adjacent to the k channels (DIS, charging delay is small) (refer to DLD of OP2, OP3, OP4 and OP6 in FIG. 6). In addition, the k channels on the left side and/or right side are controlled such that the charging delay gently increases as it goes through the k channels from left to right when charge sharing is not performed on the left area adjacent to the k channels (DIS, charging delay is small) and charge sharing is carried out on the right area adjacent to the k channels (EN, charging delay is large) (refer to ILD of OP3, OP5, OP6 and OP7 in FIG. 6). FIGS. 8A, 8B, 8C and 8D are graphs showing signal levels when FIG. 6 is applied to FIG. 7 and respectively illustrate OP3, OP4, OP5 and OP6 of FIG. 6.

Figure 9:
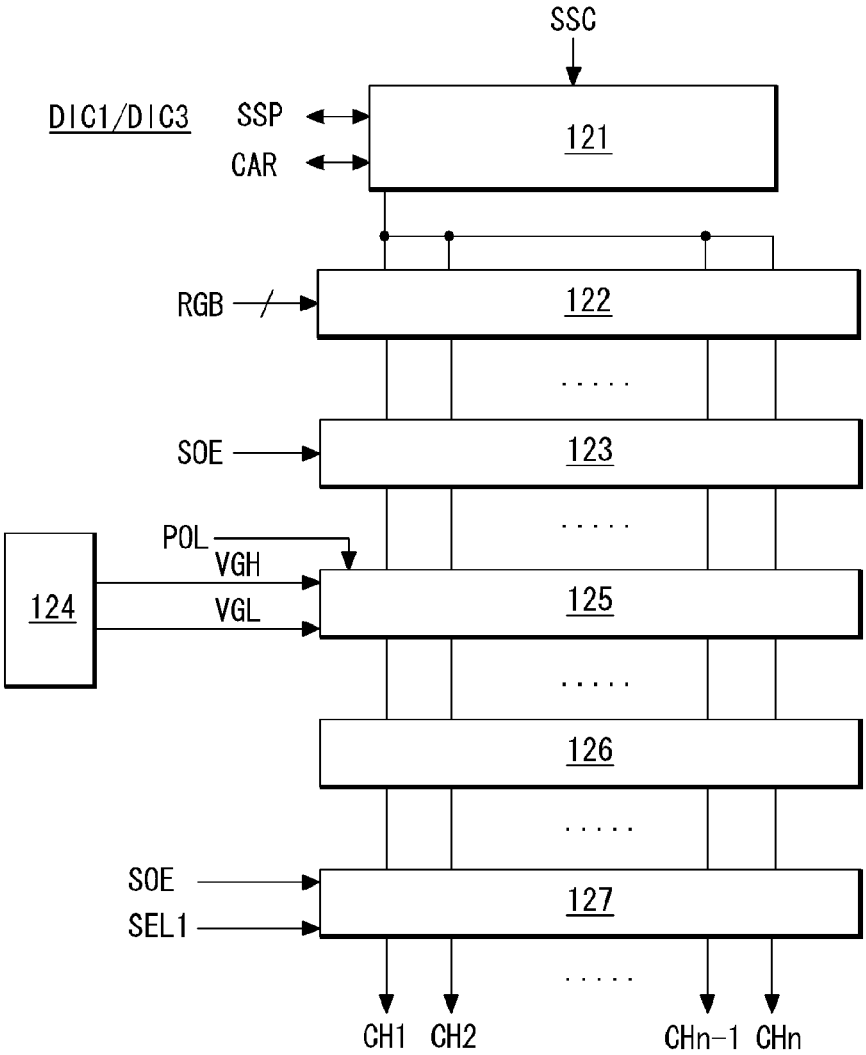
FIG. 9 illustrates an exemplary first data IC according to an embodiment of this invention.
Figure 10:
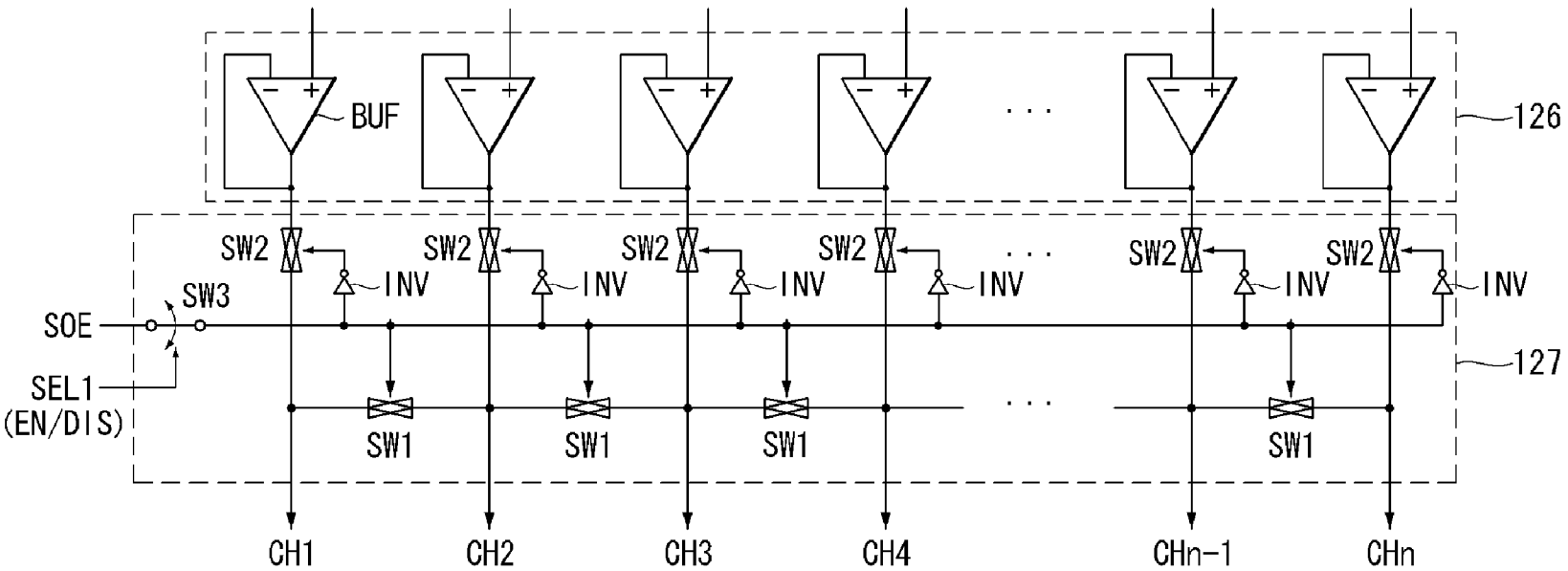
FIG. 10 illustrates output circuit and charge share circuit of the exemplary first data IC of FIG. 9 in detail.

FIG. 9 illustrates an exemplary first data IC. FIG. 10 illustrates the output circuit and charge share circuit of the exemplary first data IC of FIG. 9 in detail. The third data IC DIC3 has the same configuration as that of the first data IC DIC1.

As shown in FIG. 9, the first data IC DIC1 includes a shift register 121, a first latch array 122, a second latch array 123, a gamma compensated voltage generator 124, a digital/analog converter (hereinafter, referred to as DAC) 125, an output circuit 126, and a charge share circuit 127.

The shift register 121 shifts a sampling signal according to the source sampling clock signal SSC. Further, the shift register 121 generates a carry signal when data having a quantity greater than data quantity corresponding to the number of latches of the first latch array 122 is provided.

The first latch array 122 samples digital video data RGB from the timing controller 11 in response to the sampling signal sequentially input from the shift register 121, latches digital video data RGB corresponding to every horizontal line and simultaneously outputs data corresponding to the one horizontal line. The second latch array 123 latches the data corresponding to the one horizontal line input from the first latch array 122 and outputs the latched digital video data RGB during a logic low period of the source output enable signal SOE. At that same time, second latch arrays of the second and third data ICs DIC2 and DIC3 output digital video data RGB.

The gamma compensated voltage generator 124 segments a plurality of gamma reference voltages into voltages as many as the number of gradations that can be represented by the number of bits of the digital video data RGB to generate positive gamma compensated voltages VGH and negative gamma compensated voltages VGL corresponding to the respective gradations.

The DAC 125 includes a P-decoder (not shown) to which the positive gamma compensated voltages VGH are supplied, an N-decoder (not shown) to which the negative gamma compensated voltages VGL are provided, a multiplexer (not shown) selecting an output of the P-decoder, and an output of the N-decoder in response to the polarity control signal POL. The P-decoder decodes the digital video data RGB input from the second latch array 123 and outputs a positive gamma compensated voltage VGH corresponding to the gradation of the data. The N-decoder decodes the digital video data RGB input from the second latch array 123 and outputs a negative gamma compensated voltage VGH corresponding to the gradation of the data. The multiplexer selects a positive gamma compensated voltage VGH and a negative gamma compensated voltage VGL in response to the polarity control signal POL.

The output circuit 126 includes a plurality of buffers BUF respectively connected to output channels. The output circuit 126, shown in FIG. 10, minimizes signal attenuation of analog data voltages supplied from the DAC 125.

As shown in FIG. 10, the charge share circuit 127 includes a plurality of first switches SW1 each of which is connected between neighboring output channels, a plurality of second switches SW2 respectively connected between output terminals of the buffers BUF and the output channels, a third switch SW3 switched by the first selection signal SEL1 to selectively apply the source output enable signal SOE to the charge share circuit 127, and a plurality of inverters INV inverting the source output enable signal SOE.

The third switch SW3 is turned on in response to the enable signal EN input as the first selection signal SEL1 to apply the source output enable signal SOE to the plurality of inverters INV and the plurality of first switches SW1 of the charge share circuit 127. During a logic high period of the source output enable signal SOE, the first switches SW1 are turned on to short-circuit neighboring output channels so as to achieve charge sharing and the second switches SW2 are turned off to block the data voltages from being output. When the source output enable signal SOE is transited to a logic low level, the first switches SW1 are turned off to cancel the charge sharing operation and the second switches SW2 are turned on to allow the data voltages to be output.

The third switch SW3 is turned off in response to the disenable signal DIS input as the first selection signal SEL1 to block the source output enable signal SOE from being applied to the charge share circuit 127. In this case, the second switches SW2 maintain the previous turn-on state (turn on for resetting the circuit during a blank period between the previous frame and the current frame) and the first switches SW1 cannot be turned on, and thus the charge share circuit 127 operates without performing charge sharing.

FIGS. 11 through 17 illustrate the second data IC DIC2.

Figure 11:
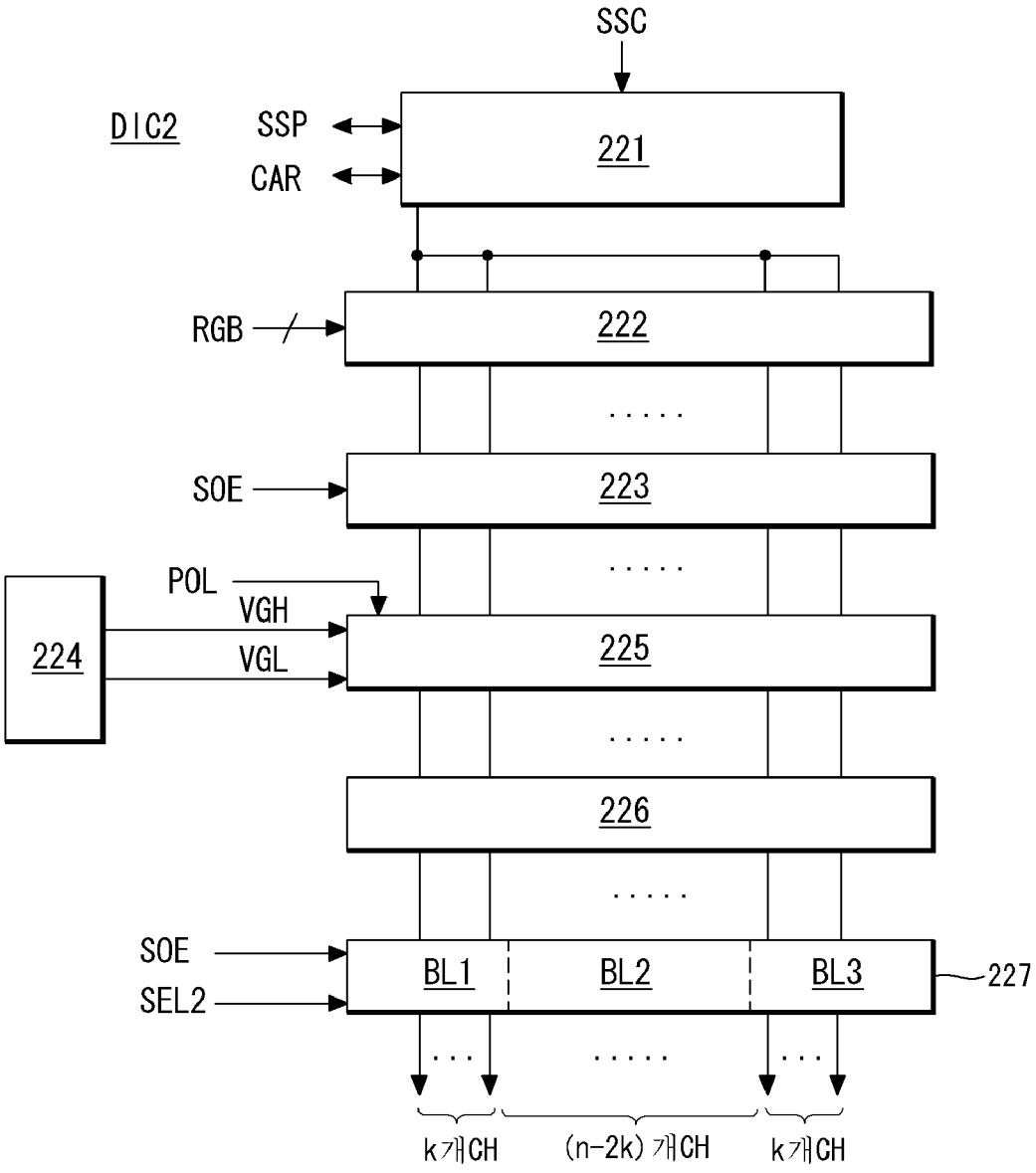
FIG. 11 illustrates an exemplary second data IC according to an embodiment of this invention.

FIG. 11 illustrates an exemplary second data IC. As shown in FIG. 11, the second data IC DIC2 includes a shift register 221, a first latch array 222, a second latch array 223, a gamma compensated voltage generator 224, a DAC 225, an output circuit 226, and a charge share circuit 227. The shift register 221, the first latch array 222, the second latch array 223, the gamma compensated voltage generator 224 and the DAC 225 perform the same functions as those of the shift register 121, the first latch array 122, the second latch array 123, the gamma compensated voltage generator 124 and the DAC 125 illustrated in FIG. 9. The charge share circuit 227 independently drives k output channels for driving the first block BL1 of the second area AREA2 of the LCD panel 10, k output channels for driving the third block BL3 of the second area AREA2 and (n−2k) output channels for driving the second block BL2 of the second area AREA2. The configuration and function of the charge share circuit 227 for operating the (n−2k) output channels are identical to those of the charge share circuit 127 illustrated in FIG. 10, except the number of output channels.

An exemplary configuration of the output circuit 226 and the charge share circuit 227 connected to each other for operating the k output channels for driving the first block BL1 or the third block BL3 is illustrated in FIGS. 12 through 16.

Figure 12:
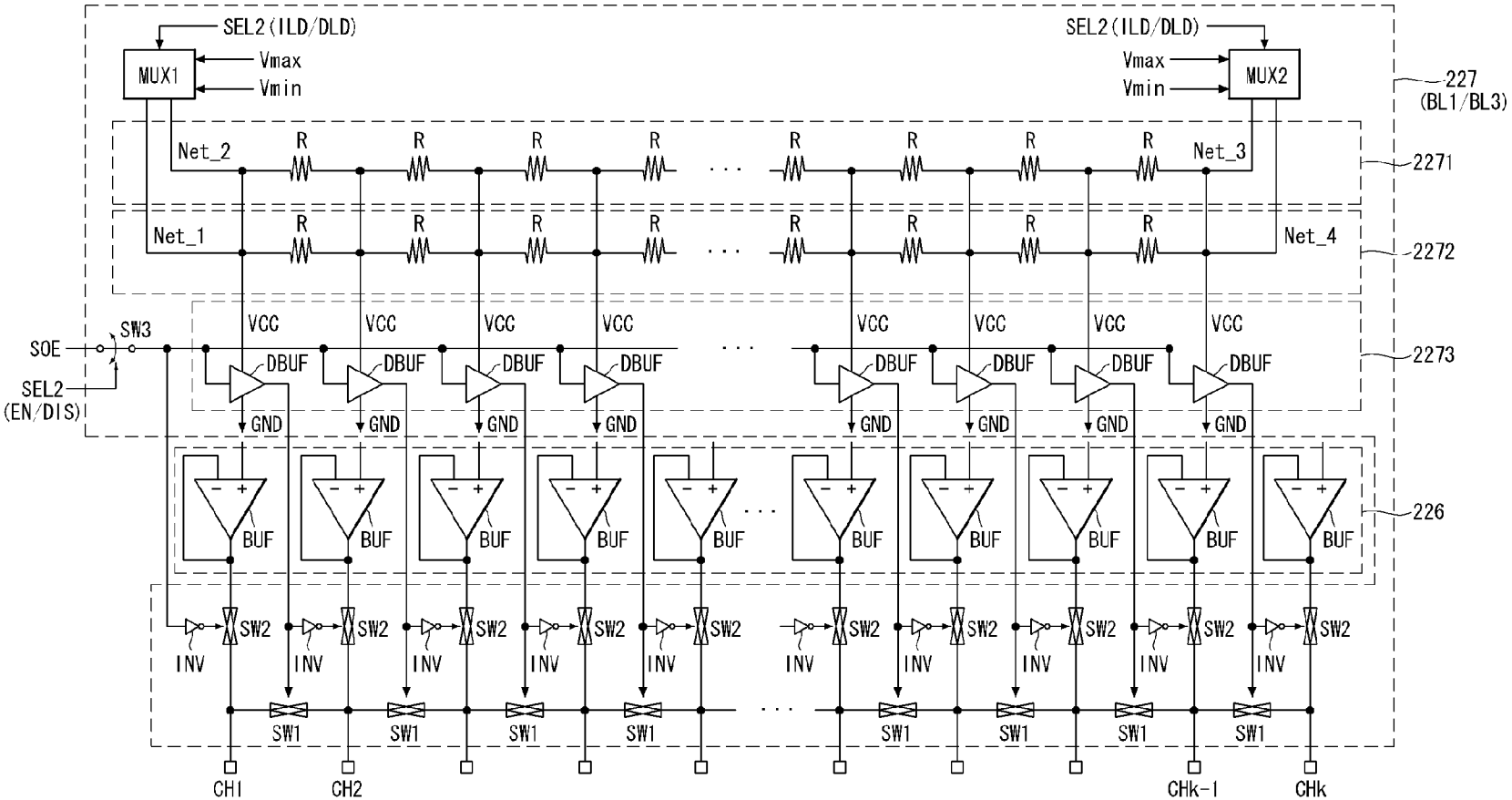
FIG. 12 is a circuit diagram showing portions of the exemplary second data IC of FIG. 11 in detail.

Referring to FIG. 12, the output circuit 226 includes a plurality of buffers BUF respectively connected to output channels and minimizes signal attenuation of analog data voltages supplied from the DAC 225.

The charge share circuit 227 includes a plurality of first switches SW1 each of which is connected between neighboring output channels, a plurality of second switches SW2 respectively connected between output terminals of the buffers BUF and the output channels, a third switch SW3 switched by the second selection signal SEL2 (EN/DIS) to selectively apply the source output enable signal SOE to the charge share circuit 227, a plurality of inverters INV inverting the source output enable signal SOE, and an SOE delay unit delaying the source output enable signal SOE applied to the first and second switches SW1 and SW2. The SOE delay unit includes a first load delay 2271 having a plurality of voltage-dividing resistors R and dividing a voltage across a first terminal Net_2 and a second terminal Net_3 thereof, a second load delay 2272 having a plurality of voltage-dividing resistors R and dividing a voltage across a first terminal Net_1 and a second terminal Net_4 thereof, first and second selectors MUX1 and MUX2 selectively operating the first and second load delays 2271 and 2272 in response to the second selection signal SEL2 (ILD/DLD), and a buffer unit 2273 having a plurality of digital buffers DBUF receiving divided voltages supplied from the first or second load delay 2271 or 2272 as a source voltage VCC, delaying the source output enable signal SOE and applying the delayed source output enable signal SOE to the first and second switches SW1 and SW2.

The first switches SW1 are turned on during a logic high period of the source output enable signal SOE and turned off during a logic low period of the source output enable signal SOE. The second switches SW2 perform an operation opposite to the operation of the first switches SW1 according to the inverters INV. The third switch SW3 is turned on in response to the enable signal EN input as the second selection signal SEL2 and turned off in response to the disenable signal DIS input as the second selection signal SEL2. The first selector MUX1 supplies a high voltage Vmax to the first terminal Net_2 of the first load delay 2271 in response to the first load delay signal ILD input as the second selection signal SEL2 and provides a low voltage Vmin to the first terminal Net_1 of the second load delay 2272 in response to the second load delay signal DLD input as the second selection signal SEL2. The second selector MUX2 supplies the low voltage Vmin to the second terminal Net_3 of the first load delay 2271 in response to the first load delay signal ILD input as the second selection signal SEL2 and provides the high voltage Vmax to the second terminal Net_4 of the second load delay 2272 in response to the second load delay signal DLD input as the second selection signal SEL2. The first load delay 2271 generates divided voltages that gradually decrease as they go from the left to the right as the source voltage VCC of the digital buffers DBUF. The second load delay 2272 generates divided voltages that gradually increase as they go from the left to the right as the source voltage VCC of the digital buffers DBUF.

Figure 13:
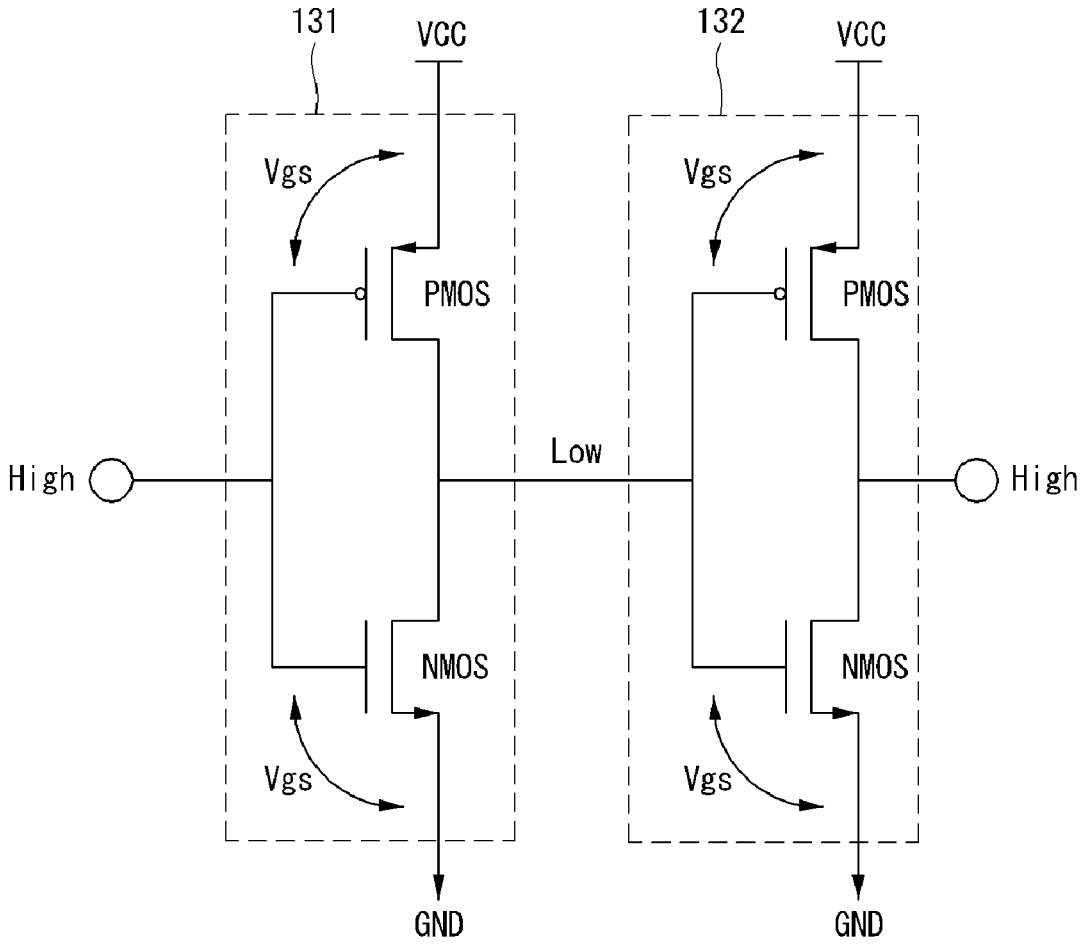
FIG. 13 is a circuit diagram of an exemplary digital buffer illustrated in FIG. 12.

Each of the plurality of digital buffers DBUF includes an inverter chain having an even number of inverters 131 and 132, as illustrated in FIG. 13. Each of the first and second inverters 131 and 132 is composed of a PMOS and a NMOS and input/output terminals of the inverters 131 and 132 are cascade-connected. Common input terminals of the inverters 131 and 132 form a MOS capacitance. The operation of the digital buffer DBUF will now be explained.

Figure 14:
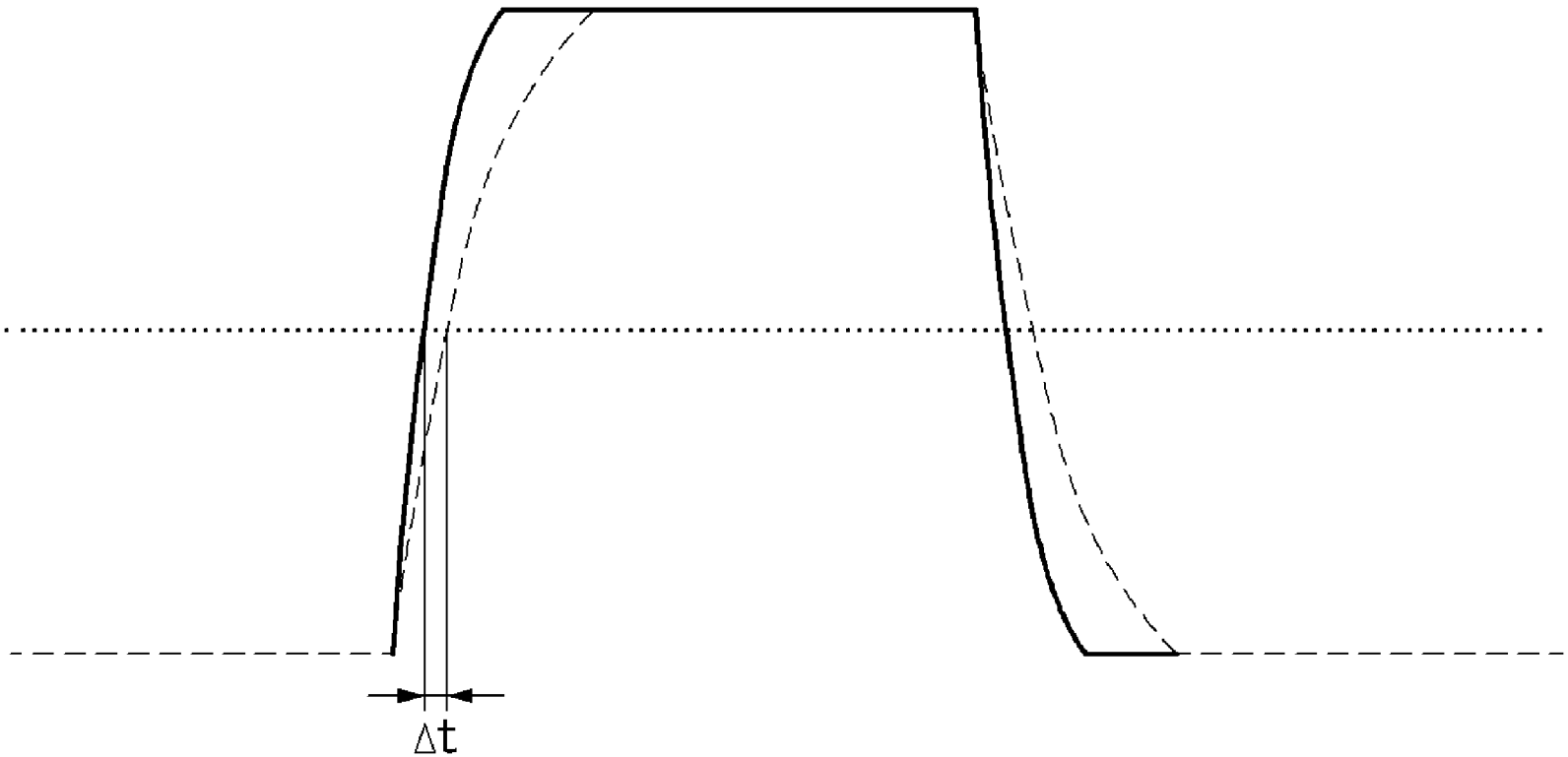
FIG. 14 is illustrates an exemplary waveform diagram for explaining the function of the digital buffer illustrated in FIG. 12.

The PMOS of the first inverter 131 is opened and the NMOS of the first inverter 131 is short-circuited in response to a high input signal, and thus the output terminal of the first inverter 131 and the input terminal of the second inverter 132 becomes logic low. The NMOS of the second inverter 132 is opened and the PMOS of the second inverter 132 is short-circuited in response to the logic low, and thus the output terminal of the second inverter 132 becomes logic high. That is, the digital buffer DBUF outputs the input signal as it is theoretically. However, the turn-on resistance (R component) of the NMOS of the first inverter 131 and the MOS capacitance (C component) of the input terminal of the second inverter 132 mutually operate to cause RC delay, and thus the digital buffer DBUF delays the input signal by a predetermined value Δt, as shown in FIG. 14, and outputs the delayed input signal in an actual operation. If the source voltage VCC decreases, the gate-source voltage Vgs of the PMOS of the first inverter 131 decreases to cause a delay in the turn-off time of the first inverter 131 and a delay in the turn-on time of the PMOS of the second inverter 132 and the turn-off time of the NMOS of the second inverter 132. That is, a delay increases as the source voltage VCC decreases.

In the charge share circuit 227 having the above-described configuration, an operation of simultaneously performing charge sharing on k channels or carrying out no charge sharing on the k channels, or carrying out charge sharing on the k channels such that a charging delay gently increases or decreases as it goes from the left to the right will now be explained.

Figure 15:
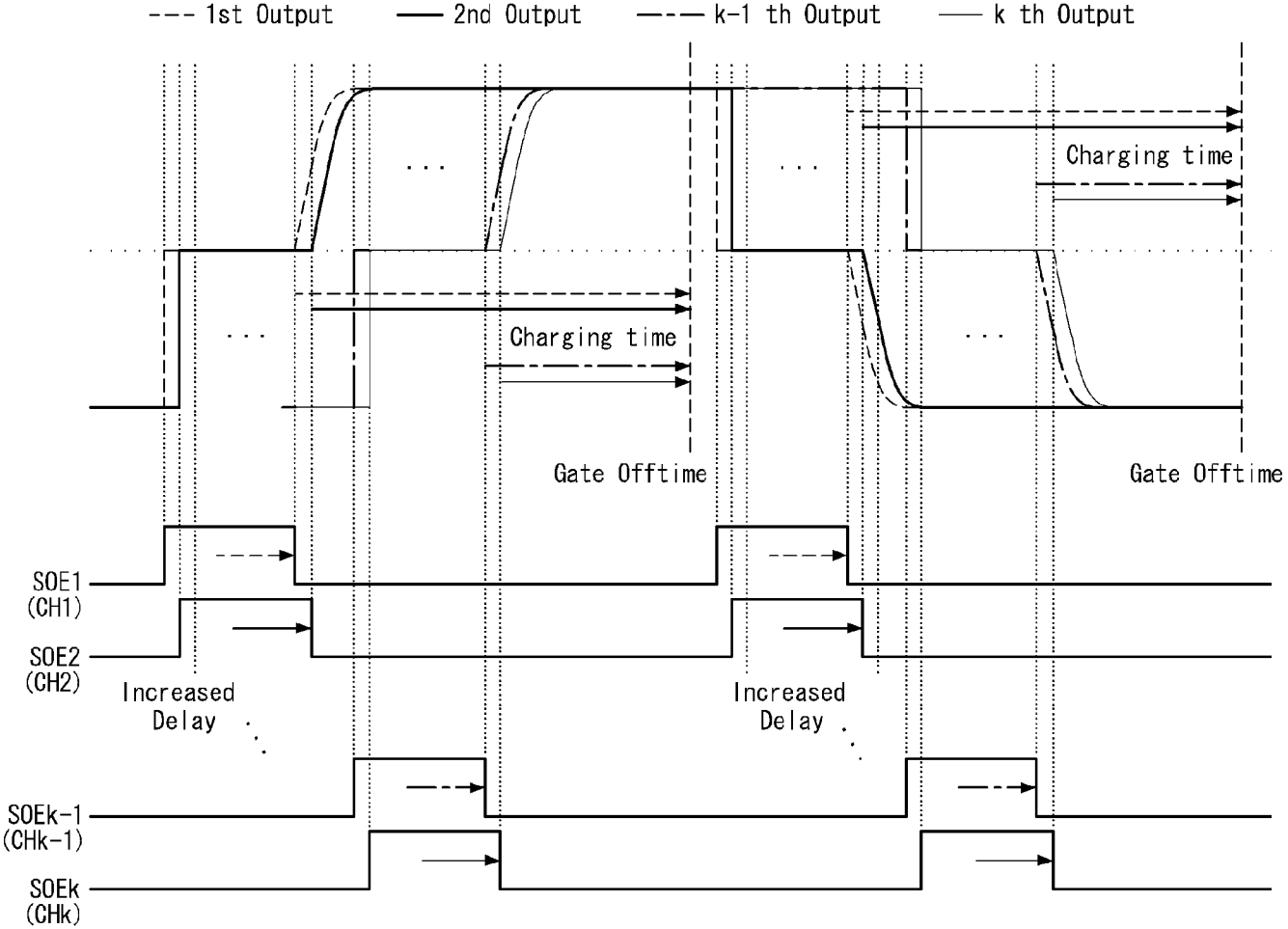
FIG. 15 illustrates an exemplary source output enable signal having a delay gradually increasing as it sequentially passes through first to kth channels and a data output waveform according to the source output enable signal according to an embodiment of this invention.

An operation of performing charge sharing on the k channels such that the charging delay gently increases as it goes from the left to the right is explained first. The third switch SW3 is turned on in response to the enable signal EN input as the second selection signal SEL2 to apply the source output enable signal SOE to the digital buffers DBUF. In this state, the high voltage Vmax is applied to the first terminal Net_2 of the first load delay 2271 and the low voltage Vmin is applied to the second terminal Net_3 of the first load delay 2271 if the first load delay signal ILD is input as the second selection signal SEL2. Here, any voltage is not applied to both terminals Net_1 and Net_4 of the second load delay 2272, and thus the second load delay 2272 is floated. Accordingly, the source voltage VCC input to the digital buffers DBUF decreases as it becomes distant from the input terminal to which the source output enable signal SOE is input due to voltage drop caused by the resistors R constructing the first load delay 2271. Consequently, the delay of the source output enable signal SOE output through the digital buffers DBUF gradually increases as the source enable signal SOE becomes apart from the input terminal to which the source output enable signal SOE is input, as shown in FIG. 15. Since the gate turn-off time of TFT is fixed according to the scan pulse signal, a gradual increase in the delay of the source output enable signal SOE as it goes from the first channel to the kth channel means a gradual decrease in charging time as it goes from the first channel to the kth channel. The quantity of charged data is reduced when the charging time decreases, and thus the charging delay gently increases as it goes through the channels from the left to the right. This can remove block dim in a boundary block in which the charging delay abruptly increases.

Figure 16:
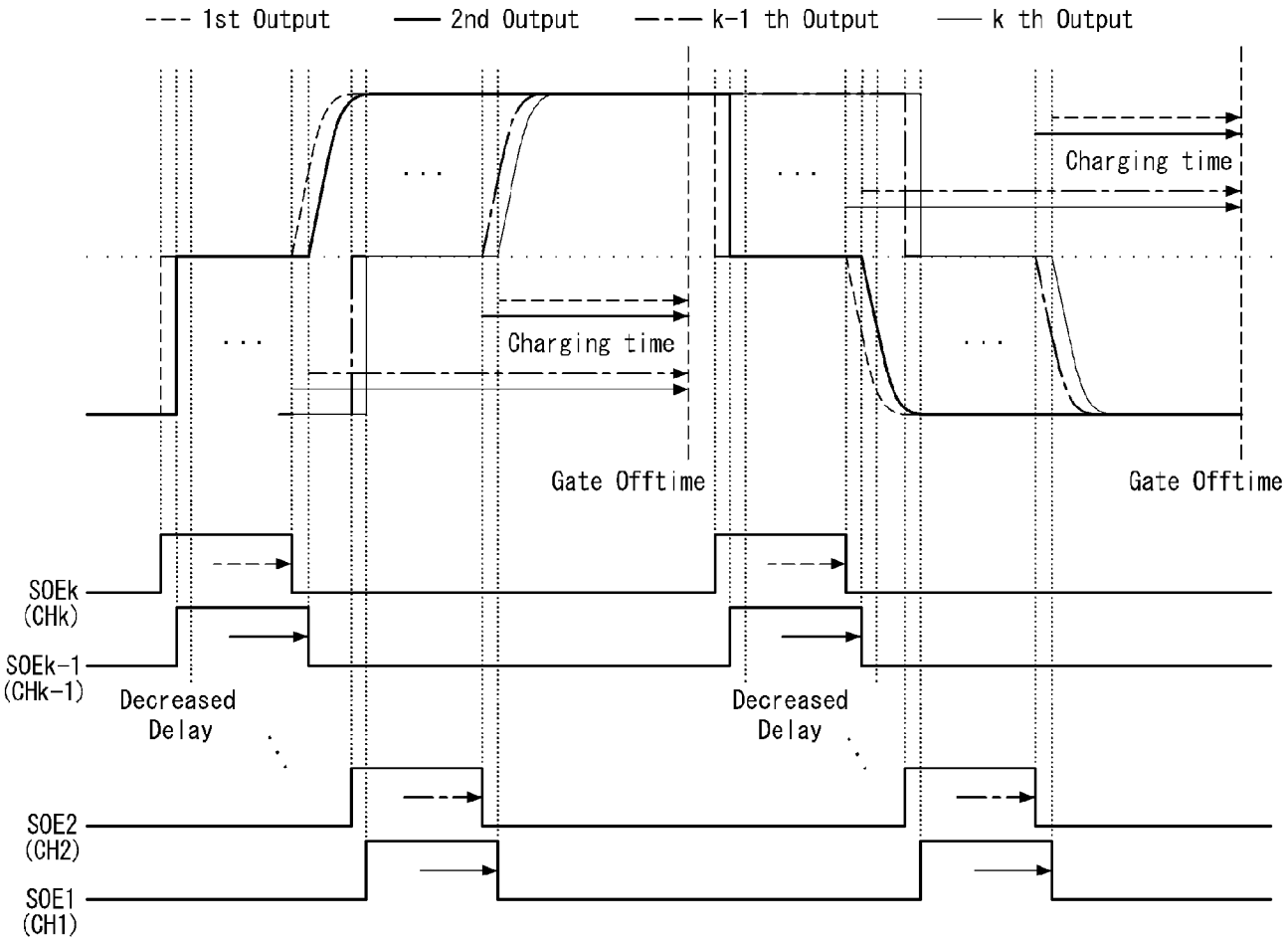
FIG. 16 illustrates an exemplary source output enable signal having a delay gradually decreasing as it sequentially passes through the first through kth channels and a data output waveform according to the source output enable signal according to an embodiment of this invention.

An operation of performing charge sharing on the k channels such that the charging delay gently decreases as it goes from the left to the right will now be explained. The third switch SW3 is turned on in response to the enable signal EN input as the second select signal SEL2 to apply the source output enable signal SOE to the digital buffers DBUF. In this state, the low voltage Vmin is applied to the first terminal Net_1 of the second load delay 2272 and the high voltage Vmax is applied to the second terminal Net_4 of the second load delay 2272 if the second load delay signal DLD is input as the second selection signal SEL2. Here, any voltage is not applied to both terminals Net_2 and Net_3 of the first load delay 2271, and thus the first load delay 2271 is floated. Accordingly, the source voltage VCC input to the digital buffers DBUF decreases as it becomes closer to the input terminal to which the source output enable signal SOE is input due to voltage drop caused by the resistors R constructing the second load delay 2272. Consequently, the delay of the source output enable signal SOE output through the digital buffers DBUF gradually decreases as it becomes apart from the input terminal to which the source output enable signal SOE is applied, as shown in FIG. 16. Since the gate turn-off time of TFT is fixed according to the scan pulse signal, a gradual decrease in the delay of the source output enable signal SOE as it goes from the first channel to the kth channel means a gradual increase in charging time as it goes from the first channel to the kth channel. The quantity of charged data increases when the charging time decreases, and thus the charging delay gently decreases as it goes through the channels from the left to the right. This can remove block dim in a boundary block in which the charging delay abruptly decreases.

To simultaneously perform charge sharing on the k channels, the source output enable signal SOE can be directly applied to the first and second switches SW1 and SW2 without passing through the digital buffers DBUF, as shown in FIG. 10. To simultaneously carry out no charge sharing on the k channels, the third switch SW3 is turned off in response to the disenable signal DIS input as the second selection signal SEL2 to block the source output enable signal SOE from being applied to the charge share circuit 227. In this case, the second switches SW2 maintain the previous turn-on state (turn-on for resetting the circuit during a blank period between the previous frame and the current frame) and the first switches SW1 cannot be turned on, and thus the charge share circuit 227 operates without performing charge sharing.

Figure 17:
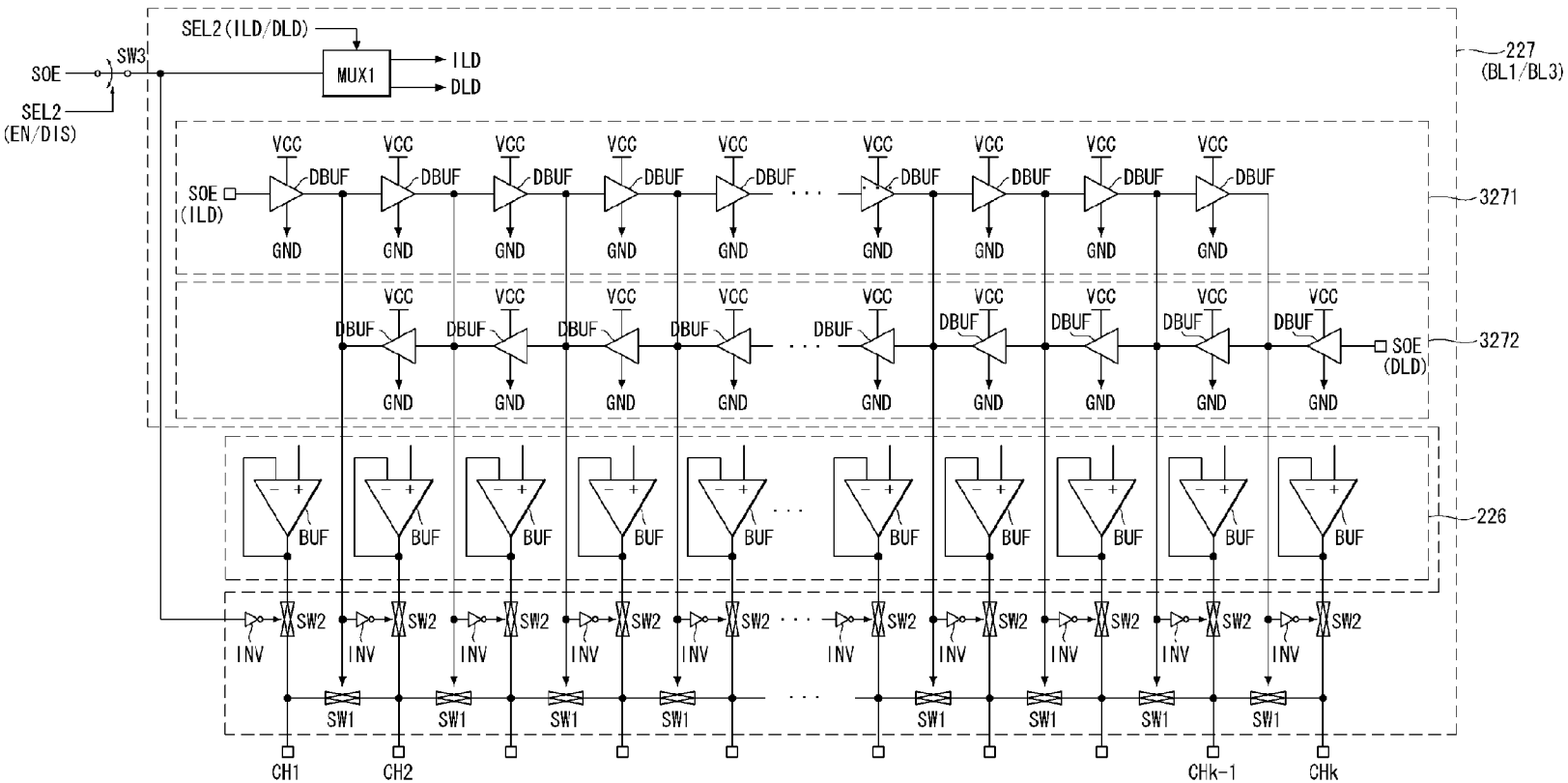
FIG. 17 illustrates another exemplary configuration of a circuit diagram showing the output circuit and the charge sharing circuit connected to each other as illustrated in FIG. 11.

FIG. 17 illustrates another configuration of the output circuit 226 and the charge share circuit 227 connected to each other with respect to k output channels for driving the first block BL1 or the third block BL3. As shown in FIG. 17, the output circuit 226 includes a plurality of buffers BUF respectively connected to output channels and minimizes signal attenuation of analog data voltages supplied from the DAC 225.

The charge share circuit 227 includes first switches SW1, second switches SW2, a third switch SW3, inverters INV and an SOE delay unit. The first switches SW1, the second switches SW2, the third switch SW3 and the inverters INV are identical to those of the charge share circuit 227 illustration in FIG. 12. The SOE delay unit includes a multiplexer MUX1, a first SOE delay 3271 having a plurality of digital buffers DBUF delaying the source output enable signal SOE such that the delay of the source output enable signal SOE gradually increases as it goes from the left to the right under the control of the selector MUX1 and applying the delayed source output enable signal SOE to the first and second switches SW1 and SW2, and a second SOE delay 3272 having a plurality of digital buffers DBUF delaying the source output enable signal SOE such that the delay of the source output enable signal SOE gradually increases as it goes from the right to the left under the control of the selector MUX1 and applying the delayed source output enable signal SOE to the first and second switches SW1 and SW2. The same source voltage VCC is applied to the digital buffers DBUF constructing the first and second SOE delay units 3271 and 3272. The digital buffers DBUF delay the source output enable signal SOE by a predetermined value using RC delay between the turn-on resistance and MOS capacitance described with reference to FIGS. 13 and 14. The operation and effect of the charge share circuit 227 using the delayed source output enable signal SOE, illustrated in FIG. 17, are identical to those of the charge share circuit illustrated in FIG. 12 except the configuration for delaying the source output enable signal SOE.

As described above, the LCD according to the present invention can analyze an input data pattern and independently determine whether charge sharing is used for respective data ICs to achieve most suitable power consumption. Furthermore, the LCD according to the present invention can independently determine whether charge sharing is used for respective data ICs to apply a new charge sharing method to a boundary block having a remarkable charging delay difference between data ICs to gently vary the charging delay. Accordingly, block dim between data ICs can be removed.

It will be apparent to those skilled in the art that various modifications and variations can be made in the liquid crystal display device of the present invention without departing from the spirit or scope of the invention. Thus, it is intended that the present invention cover the modifications and variations of this invention provided they come within the scope of the appended claims and their equivalents.

What is claimed is:

1. A liquid crystal display comprising:

a liquid crystal display panel including a plurality of data lines, a plurality of gate lines intersecting the data lines, and liquid crystal cells respectively formed at intersections of the data lines and the gate lines, and divided into a first area, a second area and a third area;

a first data integrated circuit (IC) that drives the first area;

a second data IC that drives the second area;

a third data IC that drives the third area; and a timing controller that analyzes an input digital video data, generates a first selection signal and a second selection signal for controlling whether charge sharing is used, and independently controls the first, second, and third data ICs using the first and second selection signals, wherein the second area is divided into a first block adjoining the first area, a third block adjoining the third area and a second block located between the first block and the third block; and the first selection signal controls whether the charge sharing is used for the first and third data ICs, and the second selection signal controls whether the charge sharing is used for the second block and controls a charging delay variation so that the charging delay variation is lessened between the second block and the first area or between the second block and the third area in the first or third block.

2. The liquid crystal display of claim 1, wherein the first selection signal includes an enable signal instructing the charge sharing to be used and a disenable signal instructing the charge sharing to be unused, and the second selection signal includes an enable signal instructing the charge sharing to be used, a disenable signal instructing the charge sharing to be unused, a first load delay signal controlling a charging delay in the first or third block to gradually increase, and a second load delay signal controlling the charging delay in the first or third block to gradually decrease.

3. The liquid crystal display of claim 2, wherein the second data IC comprises:

a first channel group for driving data lines of the first block;

a second channel group for driving data lines of the second block; and a third channel group for driving data lines of the third block, wherein the first channel group and the third channel group are controlled by one of the enable signal, the disenable signal, the first load delay signal and the second load delay signal, and the second channel group is controlled by one of the enable signal and the disenable signal.

4. The liquid crystal display of claim 3, wherein an operating state of the first channel group is determined according to whether a left area adjoining the first block and a right area adjoining the first block use the charge sharing or not, and an operating state of the third channel group is determined according to whether a left area adjoining the third block and a right area adjoining the first block use the charge sharing or not.

5. The liquid crystal display of claim 4, wherein the first and third channel groups are controlled to perform the charge sharing with the adjoining areas when the adjoining areas carry out the charge sharing, controlled such that the charge sharing is not performed with the adjoining areas when the adjoining areas do not carry out the charge sharing, controlled such that a charging delay gently decreases as it goes from the left to the right when the adjoining left area performs the charge sharing and the adjoining right area does not perform the charge sharing, and controlled such that the charging delay gently increases as it goes from the left to the right when the adjoining left area does not perform the charge sharing and the adjoining right area performs the charge sharing.

6. The liquid crystal display of claim 3, wherein the second data IC connected to the first and third channel groups comprises:

an output circuit including a plurality of buffers respectively connected to a plurality of output channels;

a plurality of first switches each of which is connected between neighboring output channels;

a plurality of second switches respectively connected between output terminals of the buffers and the output channels;

a third switch switched by the enable signal or the disenable signal to selectively apply a source output enable signal to the first and second switches;

a plurality of inverters inverting the source output enable signal; and a source out enable signal (SOE) delay unit delaying the source output enable signal applied to the first and second switches.

7. The liquid crystal display of claim 6, wherein the SOE delay unit comprises:

a first load delay including a plurality of voltage dividing resistors and dividing a voltage across a first terminal and a second terminal thereof;

a second load delay including a plurality of voltage dividing resistors and dividing a voltage across a first terminal and a second terminal thereof;

first and second selectors selectively operating the first and second load delays in response to the first or second load delay signal; and a plurality of digital buffers that receive divided voltages supplied from the first or second load delay as a source voltage, delay the source output enable signal, and then apply the delayed source output enable signal to the first and second switches, wherein the first and second load delays respectively divide a voltage in directions opposite to each other.

8. The liquid crystal display of claim 7, wherein each of the digital buffers includes a first inverter and a second inverter each of which is composed of a PMOS and a NMOS, and input/output terminals of the first and second inverters are cascade connected.

9. The liquid crystal display of claim 6, wherein the SOE delay unit comprises:

a selector outputting a selection signal in response to the first or second load delay signal;

a first SOE delay including a plurality of digital buffers, for delaying the source output enable signal under the control of the selector and applying the delayed source output enable signal to the first and second switches; and a second SOE delay including a plurality of digital buffers for delaying the source output enable signal under the control of the selector and applying the delayed source output enable signal to the first and second switches, wherein the first and second SOE delays respectively delay the source output enable signal opposite to each other.

10. The liquid crystal display of claim 9, wherein each of the digital buffers includes a first inverter and a second inverter each of which is composed of a PMOS and a NMOS, and input/output terminals of the first and second inverters are cascade-connected.

* * * * *